US006090055A

United States Patent [19]

Frajdenrajch

[11] Patent Number: 6,090,055

[45] Date of Patent: Jul. 18, 2000

[54] MASSAGING DEVICE

[75] Inventor: Jean Frajdenrajch, Toulouse, France

[73] Assignee: Medic Systems, Toulouse, France

[21] Appl. No.: 09/190,213

[22] Filed: Nov. 13, 1998

[30] Foreign Application Priority Data

Nov. 17, 1997 [FR] France ..... 97 14361

[51] Int. Cl.[7] ..... A61H 7/00

[52] U.S. Cl. ..... 601/7; 601/122; 601/123; 601/125; 601/133; 15/344; 15/384

[58] Field of Search ..... 601/6, 7, 8–12, 601/125, 126, 127, 123, 118–122; 15/344.345, 384, 389, 391, 394

[56] References Cited

U.S. PATENT DOCUMENTS

| | | | |
|---|---|---|---|
| 2,377,131 | 5/1945 | Conrad | 601/122 |
| 2,574,601 | 11/1951 | Swanson . | |
| 3,297,024 | 1/1967 | Robinson | 601/7 |
| 3,740,783 | 6/1973 | Kopecky | 15/345 |
| 4,903,369 | 2/1990 | Kitamura et al. | 15/384 |
| 5,665,053 | 9/1997 | Jacobs | 601/6 |
| 5,885,232 | 3/1999 | Guitay | 601/6 |
| 5,935,088 | 8/1999 | Bosley | 601/7 |

FOREIGN PATENT DOCUMENTS

| | | | |
|---|---|---|---|
| 2057514 | 5/1971 | France . | |
| 2579100 | 9/1986 | France . | |
| 2612395 | 9/1988 | France . | |
| 2723310 | 2/1996 | France . | |
| 206851 | 11/1939 | Sweden . | |
| WO 91014417 | 10/1991 | WIPO | 601/7 |

*Primary Examiner*—Stephen R. Crow
*Assistant Examiner*—Justine R. Yu
*Attorney, Agent, or Firm*—Young & Thompson

[57] ABSTRACT

A massaging device comprising a hollow case (1) which delimits a sealed suction chamber during application of the case on the skin, and a connection of this case (1) to a suction source. This massaging device comprises two parallel inner rollers (12, 13), which are accommodated entirely inside the suction chamber, and are designed to form a fold on the skin, and to roll this fold when the case (1) is displaced, and two outer rollers (16, 17), which are parallel to the inner rollers (12, 13), and are disposed to the exterior of the case (1), such as to withstand at least part of the sliding force of the case.

15 Claims, 5 Drawing Sheets

MASSAGING DEVICE

FIELD OF THE INVENTION

The invention relates to a massaging device which is designed to be displaced manually on the skin, in order to form by suction a fold of skin, and to roll the latter.

BACKGROUND OF THE INVENTION

Massaging devices of this type have been in common use for many years, in various fields such as rehabilitation, sports uses, for aesthetic purposes, and for getting back into shape etc. They were initially developed in order to automate the conventional massaging method known by physiotherapists as "palpate and roll", such as to increase the efficiency of this technique, and to eliminate the painful and traumatising phenomena of pinching by the fingers.

Most of these devices comprise a hollow case which delimits a suction chamber provided with an open lower surface, means for connection of this case to a suction source which can generate low pressure inside the suction chamber, and means for grasping the said case, which can allow the latter to be displaced on the skin.

OBJECTS OF THE INVENTION

The operating principle of these massaging devices is as follows: the partial vacuum induced by the suction source sucks the skin inside the suction chamber, and leads to the formation of a fold of skin, which is rolled when the case is displaced on the body of the patient.

THE KNOWN PRIOR ART

At present, two types of massaging devices which operate according to the above-described principle are mainly used.

SUMMARY OF THE INVENTION

The first type of device, which is described in particular in French patents FR 2,579,100 and FR 2,057,514, comprises a case, the lower edges of which delimit an open surface which provides sealing of the suction chamber when the said case is applied to the skin, two parallel inner rollers which are accommodated in the case and can form a fold on the skin, and motor means which can provide displacement of this case. These motor means conventionally consist of means which entrain one of the inner rollers in rotation. The main disadvantage of massaging devices of this type consists in the presence of drive means, which firstly increase the cost price of these devices, and secondly lead to the production of devices which are relatively voluminous, and thus difficult to handle. Furthermore, massaging devices of this type cannot be used on skin which has previously been coated with oil such as that conventionally applied for massaging purposes, since this oil would lead to slipping of the motor roller, and thus to a considerable reduction of its motor function.

In order to eliminate these disadvantages, a second type of massaging device has been developed, which does not have motor means. These massaging devices comprise mainly:

- two rollers to form a fold of skin, which are mounted such as to rotate freely around shafts which are secured inside the case, and the lower generatrix of which projects below the open lower surface of the said case, such that the said rollers can roll on the skin; and
- means for connection to a suction source, comprising a tube which opens into the space provided between and above the inner rollers.

The major disadvantage of these massaging devices is derived from the fact that, taking into account the substantial leakage lines which exist at the base of the case, it is necessary to create low pressure between the inner rollers, and thus to provide sealing between the said inner rollers and the walls of the case, in order to minimise the leakages, and to ensure that this low pressure is obtained and controlled.

In fact, at present, the only two solutions proposed in order to provide this sealing both have disadvantages:

- the first solution consists of equipping the case with additional sealing means such as skirts. However, obtaining satisfactory sealing which makes it possible to control correctly the low pressure value between the inner rollers makes it necessary to provide both longitudinal and transverse skirts, and in practice this solution is relatively complex to implement;
- the second solution, which is described in particular in patent FR 2,612,395, consists of using a case, the height of which is substantially smaller than the diameter of the inner rollers, such that the upper generatrix of the latter is disposed as close as possible to the upper wall of the said case. Although this solution makes it possible to reduce the leakages, it leads to imperfect sealing, since play must be provided between the walls of the case and the inner rollers, in order to permit rotation of the latter. Consequently, the massaging device has leakage lines which require substantial suction rates, and therefore use of a suction source with correspondingly large power and dimensions. Furthermore, owing to the existence of these leakage lines, the low pressure between the rollers is difficult to control, and use of these massaging devices is difficult, and is liable to lead to painful, or even traumatising pinching.

On the basis of this second solution, a massaging device has also been developed which is designed to improve the massaging action, and is described in patent FR 2,723,310, the inner rollers of which no longer have a fixed distance between centres, but are supported by shafts, the ends of which are accommodated in longitudinal slots provided in the case. According to this principle, the inner rollers are subjected to an effect of drawing together, which leads to production of an additional action of pinching of the skin.

However, a massaging device of this type also has a major disadvantage. In fact, since the massaging device is necessarily designed such as to obtain relative sealing between the walls of the case and the inner rollers, a portion of the surface of the latter is subjected to the low pressure which exists between the said rollers, whereas the remainder of this surface is subjected to atmospheric pressure. These inner rollers are therefore subjected to a suction force which is dependent on the suction rate and the quality of sealing, and increases together with the latter, thus constituting a parameter which is difficult to control. It should be noted that in order to compensate for this suction force, the massaging device additionally comprises resilient means which are provided in order to thrust the inner rollers, such as to move them away from one another. However, although they tend to compensate for the suction force, resilient means of this type do not make it possible to control the latter, or consequently pinching of the skin, which can therefore be painful or even traumatising.

The object of the present invention is to eliminate the disadvantages of the known applications, and its substantial objective is to provide a massaging device which has no motor means, is very flexible in use, and does not give rise to painful pinching of the skin.

Another objective of the invention is to provide a massaging device which requires only a low suction rate in order to form the fold of skin.

For this purpose, the invention relates to a massaging device which comprises:

- a hollow case comprising front and lateral walls which delimit a suction chamber, and has lower edges which are suitable for defining an open surface for application on the skin, which surface provides sealing of the said suction chamber during application of the said case on the skin;
- means for grasping the said case, which can allow the case to slide on the skin;
- means for connecting the said case to a suction source which can generate low pressure in the suction chamber.

According to the invention, this massaging device is characterised in that it comprises:

- two inner rollers which are substantially parallel, designed to form a fold on the skin and to roll the said fold during displacement of the case, the said inner rollers being mounted such as to rotate freely, and accommodated entirely inside the case, such as to be fully subjected to the low pressure which exists in the suction chamber;
- two outer rollers, which are mounted such as to rotate freely around axes which are substantially parallel to the inner rollers, the said outer rollers extending outside the said case, each in the vicinity of a front wall of the latter, such as to be fully subjected to atmospheric pressure, and to withstand at least partially the sliding force of the case;
- the inner rollers have a lower generatrix which is recessed, relative to the lower edges of the front walls of the case, and the outer rollers have a lower generatrix which projects, relative to the lower edge of the adjacent front wall, such that the lower edge of each front wall is disposed at an intermediate level, between the lower generatrices of the outer and inner rollers.

(It should be noted that the expression "recessed" means that the lower generatrix of the inner rollers extends above, or in the plane of the lower edge of the front walls. Similarly, the expression "projects" means that the lower generatrix of the outer rollers extends below, or in the plane of these lower edges).

A massaging device of this type thus comprises a case, the open lower surface of which provides sealing of the suction chamber during application of this case on the skin, and two pairs of outer and inner rollers, which are disposed, relative to the lower edge of the front walls of the said case, such that:

- the outer rollers make it possible to displace the massaging device manually on the skin, despite the suction effect provided by the case;
- the inner rollers make it possible to form a fold of skin and roll it, without any risk of painful pinching of the skin, since these inner rollers, which are fully accommodated inside the case, and therefore inside a sealed suction chamber, are subjected to identical pressure around their entire periphery, and are thus not subjected to any suction action.

In addition, a massaging device of this type has great flexibility of use, since the massaging action is dependent solely on the low pressure which exists in the suction chamber, and consequently on a parameter which is easy to control and adjust.

In addition, owing to the sealing of the suction chamber, the low pressure inside the latter which permits formation of the fold of skin, can be obtained by means of a source with a low suction rate, and thus with a small size and low cost price.

Furthermore, since the inner rollers are accommodated in a sealed chamber, the latter can have either a smooth outer rolling surface in a conventional manner, or an outer surface with any shape which is designed to improve the massaging action, such as, advantageously:

- an outer surface which has areas in relief, such as longitudinal serrations parallel to the axis of rotation of the rollers, spikes or suckers etc.;
- an outer surface which has a double-concave shape, making it possible to match better the parts massaged, which generally have a convex shape.

It should be noted that contrary to the device according to the invention, the massaging devices without motor means which are currently available, and are described in the preamble of the present application, must be provided with cylindrical rollers which have a smooth rolling surface, since sealing must be provided between these rollers and the inner surfaces of the case.

According to a first preferred variant embodiment, this massaging device can be designed such that the skin is simply rolled, without being pinched or compressed. For this purpose, the inner rollers are supported by fixed shafts, which are disposed such that the said rollers extend in the vicinity of front walls of the said case.

According to a second preferred variant embodiment, the massaging device can be designed such as to exert controlled pinching of the skin. For this purpose, the inner rollers are supported by shafts provided with ends which slide in longitudinal seats provided in the lateral walls of the said case, and are associated with resilient means provided in order to thrust the said rollers towards one another, towards a stop position, in which they are spaced by a minimal distance (x).

According to this variant embodiment, the pinching of the skin is dependent on the calibration of the resilient means, which can easily be calculated such as to prevent any risk of painful treatment.

According to another characteristic of the invention which relates to this second variant embodiment, in the position of each lateral wall of the case, the resilient means comprise a spring which connects the shafts of the inner rollers.

In addition, according to an embodiment which relates to this variant embodiment, and is designed to permit increase of the massaging pressure optionally, by means of manual action:

- one of the inner rollers has a length which is substantially shorter than the inner width of the case, such as to provide play between the ends of the said inner roller and the corresponding lateral walls of the said case;
- a transverse plate is articulated inside the case, and comprises two lower extensions, which are disposed such as to come into contact with the shaft of the inner roller, between the ends of the said roller and the corresponding lateral walls;
- a manual actuating lever is articulated on the case, and is designed to actuate a thrust system which is provided in order to come into contact with the plate, and thrust the latter such as to give rise to displacement of the inner roller in the direction of the other inner roller.

In addition, the lower edges of the front and lateral walls of the case are preferentially co-planar.

Additionally, the front walls of this case advantageously have a lower edge in the shape of a lip, with curvature which duplicates that of the outer rollers, and is designed to match the contour of the outer rollers. In fact, these lips make it possible to guide the skin towards the interior of the case, and eliminate any risk of pinching between the outer rollers and the front walls.

The lower edges of the lateral walls advantageously have a lower section which is inclined in the direction of the suction chamber delimited by the said case. This inclination makes it possible to provide the surface of the case which is applied to the skin, with a shape which makes it possible to match perfectly the parts massaged, which in practice generally have a convex shape.

According to another characteristic of the invention, the inner rollers have sections with ends which have a frusto-conical shape, with a cross-section which decreases in the direction of the said ends, such as to eliminate any risk of pinching of the skin between these rollers and the lateral walls of the case.

According to another characteristic of the invention, the lateral walls of the case have extensions in the elongation of the front walls, such as to form two jaws to accommodate the ends of the shafts of the outer rollers.

According to another characteristic of the invention, the means for connection of the case to the suction source comprise a median aperture, which is provided with a connection joining piece, and is disposed in the upper part of the said case.

According to a variant embodiment relating to these connection means, the grasping means comprise an elongate tubular handle, which is connected to the upper part of a front wall of the case, and accommodates a tube which opens into the said case, and has a free end which is provided with a connection joining piece.

BRIEF DESCRIPTION OF THE DRAWINGS

Other characteristics, objects and advantages of the invention will become apparent from the following detailed description, provided with reference to the attached drawings, which represent by way of non-limiting example four preferential embodiments. In these drawings, which are an integral part of the description.

DETAILED DESCRIPTION OF THE INVENTION

The massaging devices which are shown respectively in FIGS. 1–3, 4–6, 8 and 9, are designed to be displaced manually on the parts of the body to be treated, and to carry out a massaging action which consists of forming and rolling a fold of skin.

Figure 1:
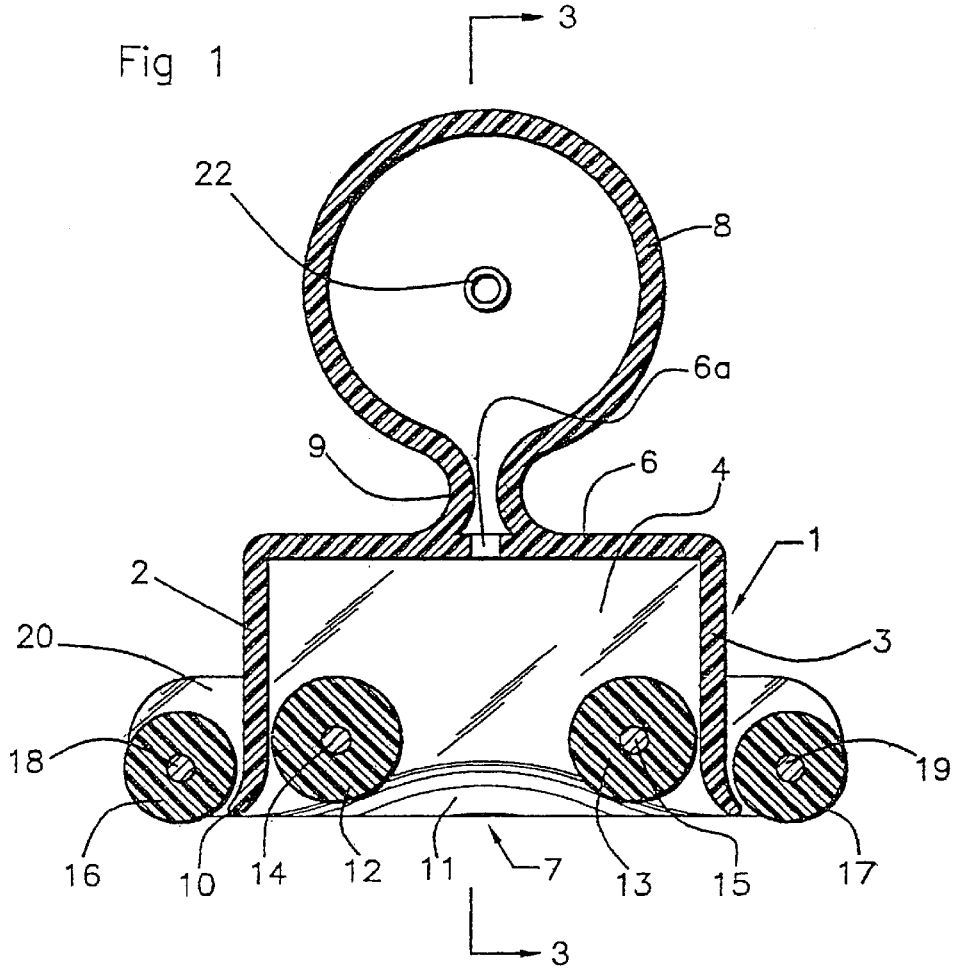
FIG. 1 is a longitudinal cross-section on the line 1—1 of FIG. 3 of a first variant of the massaging device according to the invention.
Figure 2:
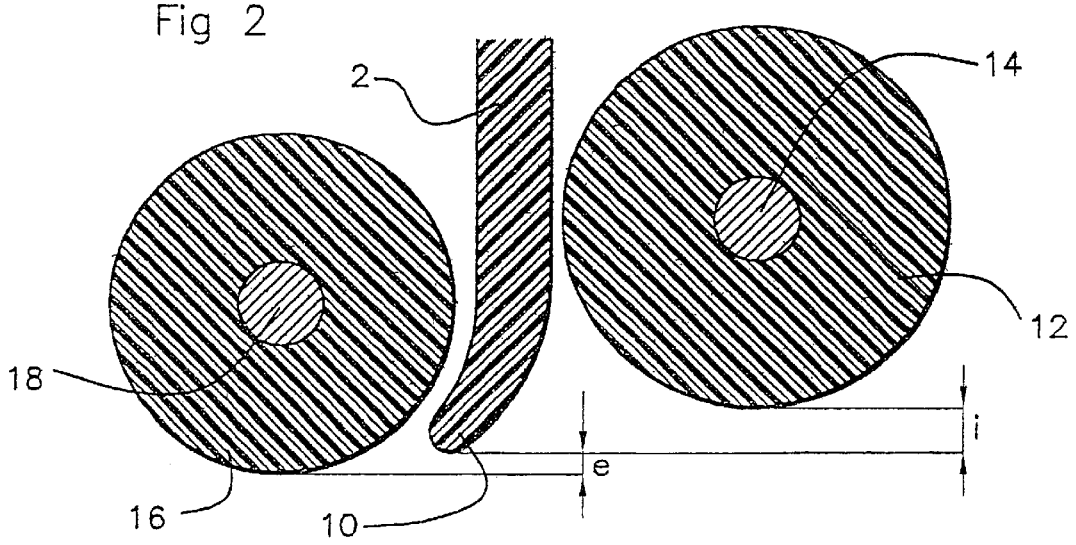
FIG. 2 is a partial longitudinal cross-section on line 1—1 of FIG. 3 and on an enlarged scale, of one of the longitudinal ends of this massaging device.
Figure 3:
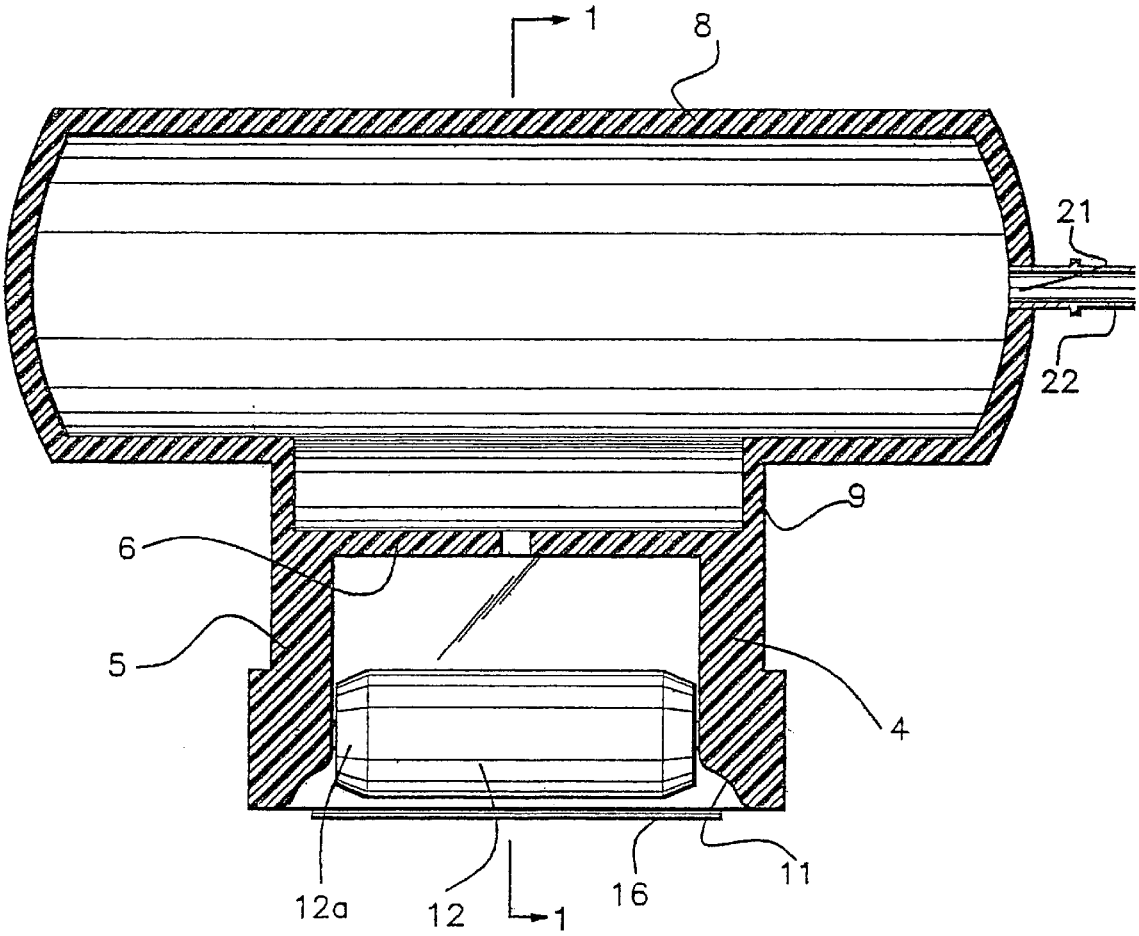
FIG. 3 is a transverse cross-section on the line 3—3 of FIG. 1 B.

The massaging device which is shown in FIGS. 1 to 3 comprises firstly a case 1, which has a generally rectangular parallelepiped shape, which delimits a suction chamber, and comprises two front walls 2, 3, two lateral walls 4, 5, an upper wall 6, and an open lower surface 7, for application of the said case on the skin.

On top of this case 1, there is also disposed a cylindrical transverse handle 8, which has a length longer than the width of the said case, and is connected to the upper wall 6 of the latter by an element 9 in the shape of a neck. This upper wall 6 also contains an aperture 6*a*, which opens respectively inside the suction chamber, and inside the handle 8.

In addition, the front walls 2, 3 of the case 1 have lower edges in the shape of lips 10, which are curved towards the exterior.

The lower edges of the lateral walls 4, 5 have a field 11 which is inclined in the direction of the suction chamber, and has a concave transverse shape, such that the application surface of the case 1 matches perfectly the parts to be massaged, which have a generally convex shape.

This massaging device also comprises parallel inner rollers 12, 13, which are fully accommodated inside the case 1, are supported by fixed shafts 14, 15 parallel to the front walls 2, 3, and are disposed such that the said inner rollers extend in the vicinity of the said front walls.

As shown in detail in FIG. 3, these inner rollers 12, 13, which are designed to form a fold of skin and roll it, are disposed such as to have a lower generatrix which is recessed relative to the lower edges 10 of the front walls 2, 3, at a distance (i) of approximately a few millimetres above the said lower edges.

In addition, these inner rollers 12, 13 have end sections such as 12*a*, with a frusto-conical shape with a cross-section which decreases in the direction of the said ends.

The massaging device also comprises two outer rollers 16, 17, which are mounted such as to rotate freely around fixed shafts 18, 19, which are parallel to the shafts 14, of the inner rollers 12, 13. These outer rollers 16, 17, which are designed to enable the case 1 to slide on the skin, are disposed to the exterior of the case 1 in the vicinity of the front walls 2, 3 of the latter. For this purpose, in their lower part, the lateral walls 4, 5 of the case 1 have flanks such as 20, in the elongation of each of the front walls 2, 3, forming two jaws to accommodate the shafts 18, 19 of these outer rollers 16, 17.

As shown in detail in FIG. 2, these outer rollers are disposed such as to have a lower generatrix which projects relative to the lower edge 10 of the adjacent front wall, at a distance (e) of approximately a few millimetres below the said lower edge.

In addition, as shown in FIG. 3, the curvature of the lips 10 of the front walls 2, 3 is designed such that the latter match the contour of these outer rollers 18, 19.

Finally, this massaging device has an axial aperture 21, which is provided in one of the lateral walls of the handle 8, and is equipped with a joining piece 22 for connection to a suction source (not shown), such as an adjustable vacuum pump.

A massaging device of this type can firstly be displaced manually on the skin by means of the presence of the outer rollers 16, 17, which are subjected to atmospheric pressure Pa, even if the part to be massaged is coated with oil.

Figure 7:
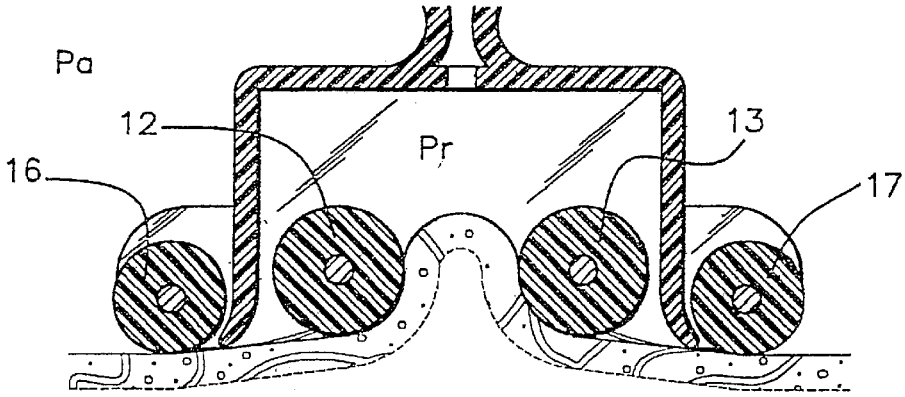
FIG. 7 is a longitudinal cross-section which illustrates the massaging action obtained by means of a massaging device according to the invention.

As shown in FIG. 7, the device leads to creation of a massaging action which consists of forming a fold of skin between the inner rollers 12, 13, which are fully subjected to the low pressure Pr, and of rolling the said fold between the said rollers, when the case 1 is displaced. During this massaging, the intensity of which depends only on the low pressure Pr which exists in the suction chamber, the arrangement of the inner rollers 12, 13, which are accommodated entirely inside the case 1, and are thus not subjected to any suction action, also protects against any pinching of the skin, which can be uncomfortable for, or can injure the patient.

Figure 4:
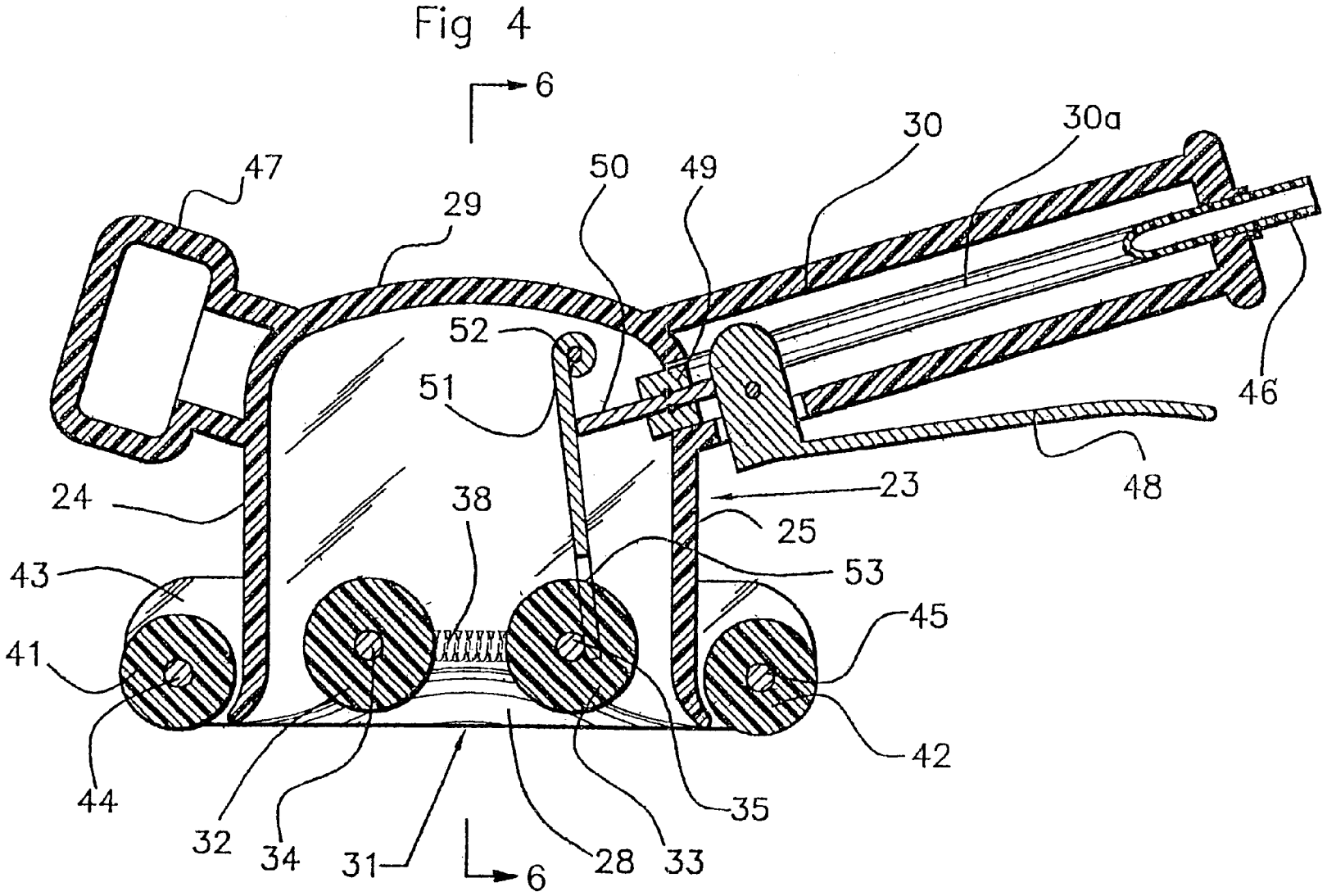
FIG. 4 is a longitudinal cross-section on the line 4—4 of FIG. 6, of a second variant of a massaging device according to the invention.
Figure 5:
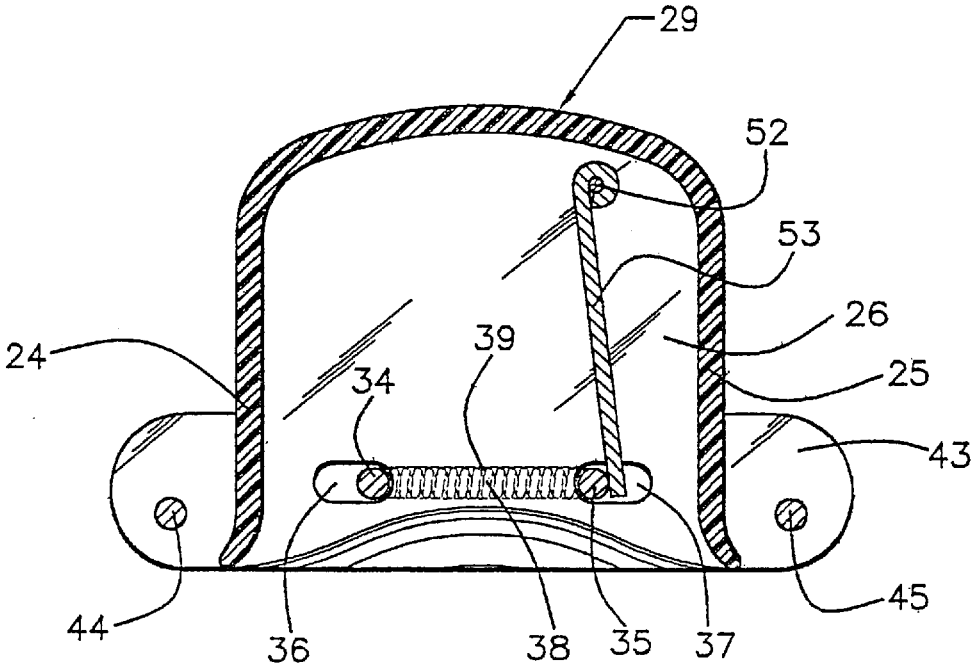
FIG. 5 is a longitudinal cross-section on the line 5—5 of FIG. 6 of this second variant.
Figure 6:
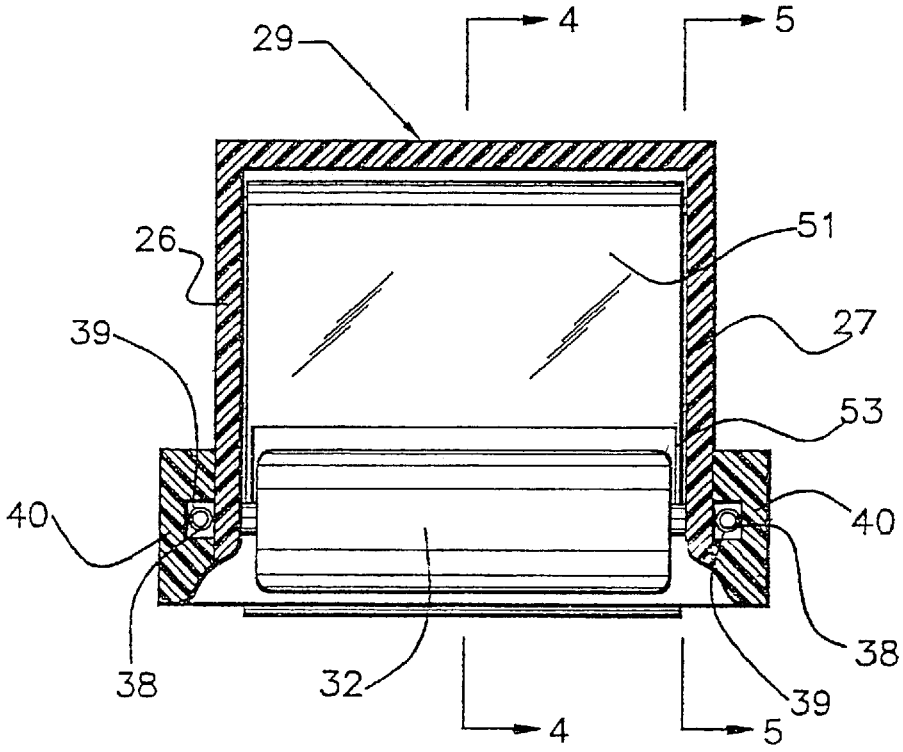
FIG. 6 is a transverse cross-section on the line 6—6 of FIG. 4.

The massaging device shown in FIGS. 4 to 6 is similar in its operating principle to that already described, but in addition also makes it possible to pinch the skin in a controlled manner, without any risk of causing discomfort or injury to the patient.

This massaging device comprises a case 23, which delimits a suction chamber, and comprises:

- two parallel front walls 24, 25, the lower edges of which are in the shape of lips;
- two parallel lateral walls 26, 27, the lower edges of which have an area 28 with a concave shape, which is inclined in the direction of the suction chamber;
- a rounded upper wall 29; and
- an open lower surface 31, for application of the case on the skin 23.

This massaging device additionally comprises two axial grasping handles 30, 47, which are each disposed in the elongation of a front wall 24, 25, and allow the device to be displaced easily in either direction;

- a cylindrical tubular handle 30, which is connected to the upper part of one of the front walls 25. This handle 30, which is inclined upwards relative to the case 23, also accommodates a tube 30*a* for connection to a suction source, which opens into the case 23, and has a connection joining piece 46 at its free end; and
- a handle 47, the longitudinal cross-section of which is generally in the shape of a T, and is connected to the upper part of the other front wall 24.

As in the previous case, this massaging device also comprises two inner rollers 32, 33. However, these inner rollers 32, 33 do not have a fixed distance between centres, but are supported by shafts 34, 35, the ends of which extend through longitudinal coaxial slots 36, 37, provided at a distance from one another in each of the lateral walls 26, 27 of the case 23.

The corresponding ends of each of the two shafts 34, 35 are also connected by springs such as 38, which are designed to thrust the inner rollers 32, 33 towards one another, towards a stop position, where they are spaced by a minimal distance, corresponding to the longitudinal distance which separates the two slots 36, 37.

In addition, the springs extend to the exterior of the lateral walls 26, 27 of the case, and are each accommodated in a longitudinal groove 39 provided in a counter-plate 40, which is connected to the corresponding lateral wall.

In addition, one of the inner rollers 33 has a length which is substantially shorter than the inner width of the case 23, such as to provide play between the ends of the said roller and the lateral walls 26, 27 of the said case. The purpose of this play is to make it possible to exert manually on the shaft 35 of this inner roller 33 a force which tends to draw it closer to the other inner roller, for the purpose optionally of increasing the massaging pressure of the said inner rollers.

For this purpose, the massaging device comprises firstly a transverse plate 51, which is accommodated in the case 23, and is supported by a transverse articulation shaft 52, which extends in the upper part of the said case. This transverse plate 51 has a height such that its lower end is disposed above the upper generatrix of the inner roller 33, and is extended downwards, at each of its ends, by a rigid rod such as 53, which is disposed such as to come into contact with the shaft 35 of the said inner roller.

The massaging device additionally comprises a manually activated lever 48, which extends along the handle 30, is articulated in the interior of the latter, and is designed such that when it is actuated, it displaces the rod 49 of a piston system which is of a known type, and is provided for example with a return spring, which is disposed such as to come into contact with the plate 51.

The device additionally comprises two outer rollers 41, 42, which are similar to those of the previous device, supported between flanks such as 43, which form jaws to accommodate the shafts 44, 45 of these outer rollers.

A massaging device of this type, the arrangement of the inner rollers 32, 33 and outer rollers 41, 42 of which relative to the lips of the front walls 24, 25, is identical to that shown in FIG. 3, thus makes it possible to carry out massaging by formation and rolling of a fold of skin. It also makes it possible to exert a controlled action of pinching the skin, on the basis of adjustment of the springs 38, which tend to oppose spacing of the inner rollers 32, 33, and optionally to increase this action manually by means of the lever 48.

Figure 8:
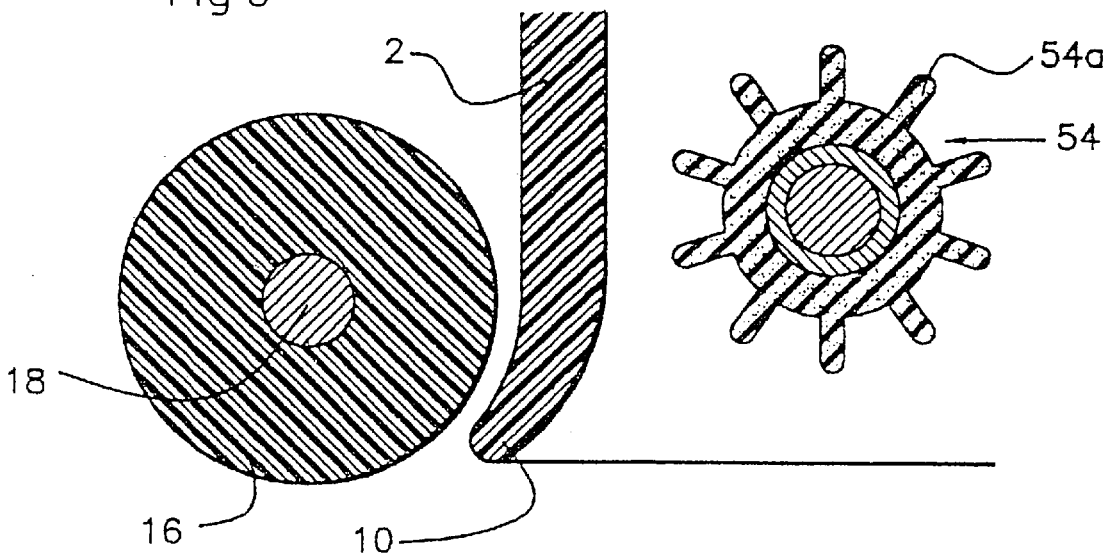
FIG. 8 is a partial longitudinal cross-section of a third variant of a massaging device according to the invention.

FIG. 8 shows another variant embodiment, in which the inner rollers 54 have a rolling surface which contains serrations 54*a*, parallel to the axis of rotation of the said rollers.

Figure 9:
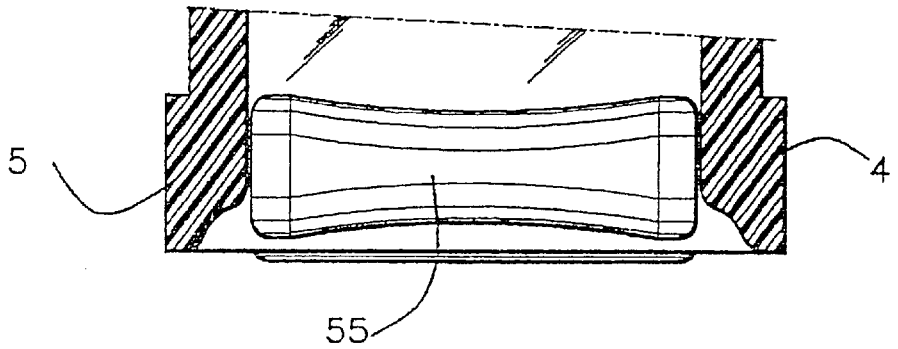
FIG. 9 is a transverse cross-section of a fourth variant of a massaging device according to the invention.

Finally, FIG. 9 shows a last variant, according to which the inner rollers 55 have a double-concave shape, which is particularly suitable for matching in the best possible way the parts massaged, which generally have a convex shape.

What is claimed is:

1. A massaging device for movement over the skin of an individual, comprising a hollow case comprising opposite front walls and opposite lateral walls which delimit a suction chamber, means for grasping the case to slide the case over the skin, means for connecting said case to a suction source to generate low pressure in the suction chamber, two inner rollers having substantially parallel axes between said front and lateral walls disposed entirely within said suction chamber, and two outer rollers having axes substantially parallel to the axes of said inner rollers, said hollow case being disposed between said outer rollers such that one outer roller is on the side of one said front wall opposite said inner rollers and the axis of the other outer roller is on the side of the other said front wall opposite said inner rollers, said front and lateral walls having lower edges and said inner rollers having lower generatrices which are higher than said lower edges and said outer rollers having lower generatrices which are lower than said lower edges.

2. A massaging device as claimed in claim 1, said lower edges of said front and lateral walls being coplanar.

3. A massaging device as claimed in claim 1, said lower edges of said front walls having a curvature which duplicates the curvature of said outer rollers.

4. A massaging device as claimed in claim 1, wherein said lower edges of the lateral walls are inclined downwardly toward each other.

5. A massaging device as claimed in claim 1, wherein said inner rollers have end sections which have a frustoconical shape with a cross section that decreases in the direction of opposite ends of said inner rollers.

6. A massaging device as claimed in claim 1, and fixed shafts on which said inner rollers are rotatably mounted, said shafts being so positioned that said inner rollers are each adjacent one of said front walls.

7. A massaging device as claimed in claim 1, further comprising shafts on which said inner rollers are mounted, said shafts having ends which slide in longitudinal seats in said lateral walls, and resilient means acting on said shafts to urge the said rollers toward each other.

8. A massaging device as claimed in claim 7, said resilient means comprising springs.

9. A massaging device as claimed in claim 8, said longitudinal seats comprising slots that receive ends of said shafts, said springs being disposed on outer sides of said lateral walls and being each accommodated in a groove provided in a counter-plate mounted on a corresponding said lateral wall.

10. A massaging device as claimed in claim 1, one of said inner rollers having a length which is substantially shorter than an inner width of said case, there being substantial play between ends of said inner roller and said lateral walls of said case, a transverse plate articulated inside the case and comprising two lower extensions which are disposed so as to come into contact with a shaft of said inner roller between the ends of said roller and said lateral walls, and a manually actuated lever articulated on the case to actuate a thrust system disposed so as to come into contact with the plate and to thrust the plate so as to displace a said inner roller in the direction of the other said inner roller.

11. A massaging device as claimed in claim 1, wherein said lateral walls have extensions extending beyond said front walls such as to form pairs of jaws to accommodate ends of shafts of said outer rollers.

12. A massaging device as claimed in claim 1, wherein said means for connecting said case to a suction source comprises a joining piece disposed in an upper part of said case.

13. A massaging device as claimed in claim 1, wherein said grasping means comprise an elongated tubular handle connected to an upper portion of a said front wall of the case.

14. A massaging device as claimed in claim 1, wherein said inner rollers are concave.

15. A massaging device as claimed in claim 1, wherein said inner and outer rollers have smooth peripheral surfaces.

* * * * *